United States Patent [19]

Shimokawa et al.

[11] Patent Number: 4,877,067

[45] Date of Patent: Oct. 31, 1989

[54] APPARATUS FOR DISTRIBUTEDLY FILLING PARTICULATE OR GRANULAR MATERIAL INTO CONTAINERS

[75] Inventors: Masao Shimokawa; Hisanori Hamada, both of Tokushima, Japan

[73] Assignee: Shikoku Kakoki Co., Ltd., Tokushima, Japan

[21] Appl. No.: 247,192

[22] Filed: Sep. 21, 1988

[30] Foreign Application Priority Data

Sep. 25, 1987 [JP] Japan ..... 62-146568[U]

[51] Int. Cl.[4] ..... B65B 43/42

[52] U.S. Cl. ..... 141/129; 141/134; 141/144; 141/147; 141/167; 141/174; 141/178; 141/237

[58] Field of Search ..... 141/129, 131, 134, 135, 141/137, 138, 144, 145, 147, 167, 178, 179, 180, 182, 174, 234, 275, 248, 237, 168

[56] References Cited

U.S. PATENT DOCUMENTS

| | | | |
|---|---|---|---|
| 1,075,534 | 10/1913 | Ash | 141/135 X |
| 2,491,826 | 12/1949 | Meyers et al. | 141/248 X |
| 2,753,099 | 7/1956 | Jenner et al. | 141/145 |
| 2,975,809 | 3/1961 | Ninneman et al. | 141/178 X |
| 3,045,720 | 7/1962 | Jungmayr et al. | 141/145 |
| 3,152,622 | 10/1964 | Rothermel | 141/179 X |
| 3,275,043 | 9/1966 | Dobbyn | 141/147 X |
| 4,585,040 | 4/1986 | Gramer | 141/137 |

FOREIGN PATENT DOCUMENTS

| | | | |
|---|---|---|---|
| 2821775 | 11/1979 | Fed. Rep. of Germany | 141/131 |
| 428543 | 7/1967 | Switzerland | 141/134 |

*Primary Examiner*—Ernest G. Cusick

*Attorney, Agent, or Firm*—Armstrong, Nikaido, Marmelstein, Kubovcik & Murray

[57] ABSTRACT

An apparatus for filling a particulate or granular material into containers which includes a container conveyor having an even number of container transport paths and a material conveyor having an endless path of transport of the material including a forward path portion and a return path portion with the path portions extending across the container transport paths and being positioned thereabove. The container transport paths are divided into a first group of the even-numbered paths as arranged from one side of the container conveyor and a second group of the other odd-numbered paths. At the intersection of the two conveyors, the material is distributedly placed into containers in the two groups of paths separately from the forward path portion and the return path portion of the material transport path, whereby a sufficient period of time is made available for filling the material into the containers.

4 Claims, 7 Drawing Sheets

APPARATUS FOR DISTRIBUTEDLY FILLING PARTICULATE OR GRANULAR MATERIAL INTO CONTAINERS

BACKGROUND OF THE INVENTION

This invention relates to an apparatus for distributedly filling, for example, particulate or granular materials, which are the ingredients of noodles, into containers, i.e. cups, for preparing prepackaged noodles.

Such apparatus are already known which comprise a container conveyor having a plurality of transport paths and adapted to be driven intermittently so as to stop containers at a specified filling station during transport, chutes equal in number to the number of transport paths and each having a lower-end opening positionable above the container stopped at the filling station, a particulate or granular material conveyor having an endless chain and buckets provided with a bottom closure and attached to the chain at the same spacing as the container transport paths, the buckets being movable above the upper-end openings of the chutes when traveling along the forward path of the chain, the material conveyor being so driven continuously that while the container conveyor is intermittently driven each bucket moves by a distance equal to the spacing between the adjacent chutes multiplied by the number of chutes, and the closure opening means operable only once every time the container conveyor is intermittently driven once to open the closures of the buckets positioned above the upper-end openings of the respective chutes and to thereafter close the closures.

When it is attempted to increase the number of container transport paths with the speed of operation of the container conveyor unchanged to increase the filling capacity of the apparatus, there arises a need to corresponding increase the speed of operation of the material conveyor. This shortens the time required for a bucket to pass over the upper-end opening of the chute and consequently reduces the time interval during which the bucket closure is left open above the chute and causing trouble to the filling operation since a sufficient period of time is no longer available for the transfer of the material from the bucket to the chute.

SUMMARY OF THE INVENTION

The main object of the present invention is to provide an apparatus for filling a particulate or granular material into containers free of the above problem.

The apparatus of the present invention for distributedly filling a particulate or granular material into containers comprises an apparatus frame having first and second filling stations; a container conveyor having an even number of spaced container transport paths extending through the first and second filling stations, the container conveyor being adapted to be driven intermittently so as to stop containers at the first and second filling stations during transport; first chutes equal in number to one-half of the number of container transport paths and so arranged and spaced as to their lower-end openings dispersed above the respective containers stopped at the first filling station in the even-numbered transport paths as arranged from one side of the container conveyor; second chutes equal in number to one-half of the number of container transport paths and so arranged and spaced as to have their lower-end openings dispersed above the respective containers stopped at the second filling station in the odd-numbered transport paths as arranged from the above-mentioned side of the container conveyor; a particulate or granular material conveyor having an endless material transport path including a forward path portion and a return path portion, the path portions extending across and being positioned above the even number of spaced container transport paths, the material conveyor having a chain extending along the material transport path and first and second buckets arranged alternately and attached to the chain at the same spacing as the container transport paths, the buckets being movable above the upper-end openings of all the first chutes when traveling through the forward path portion and above the upper-end openings of all the second chutes when traveling through the return path portion, the material conveyor being so driven continuously that each time the container conveyor is intermittently driven, each bucket moves by a distance equal to the spacing between adjacent chutes multiplied by the number of first or second chutes, a number of the first buckets being positionable above the upper-end openings of the respective first chutes and a number of the second buckets being positionable above the upper-end openings of the respective second chutes when containers being transported are stopped at the first and second filling stations; and means operable only once each time the container conveyor is intermittently driven once to place the particulate or granular material into the first and second chutes respectively from the first and second buckets positioned above the upper-end openings of the first and second chutes while the containers are stopped at the first and second filling stations.

With the present invention, the particulate or granular material is transferred from buckets to containers on the container conveyor separately in the forward path portion and the return path portion of the material conveyor. This provides a longer period of time for filling than in the case where the material is filled, for example, only in the forward transport path as in the conventional apparatus.

DESCRIPTION OF THE PREFERRED EMBODIMENT

An embodiment of the invention will be described below with reference to the drawings.

In the following description, the term "front" refers to the direction toward which containers C are transported by a container conveyor 11 (i.e. downward in FIG. 1), the term "rear" to the direction opposite to the above, and the terms "left" and "right" are used as the apparatus is viewed in FIG. 2.

Figure 1:
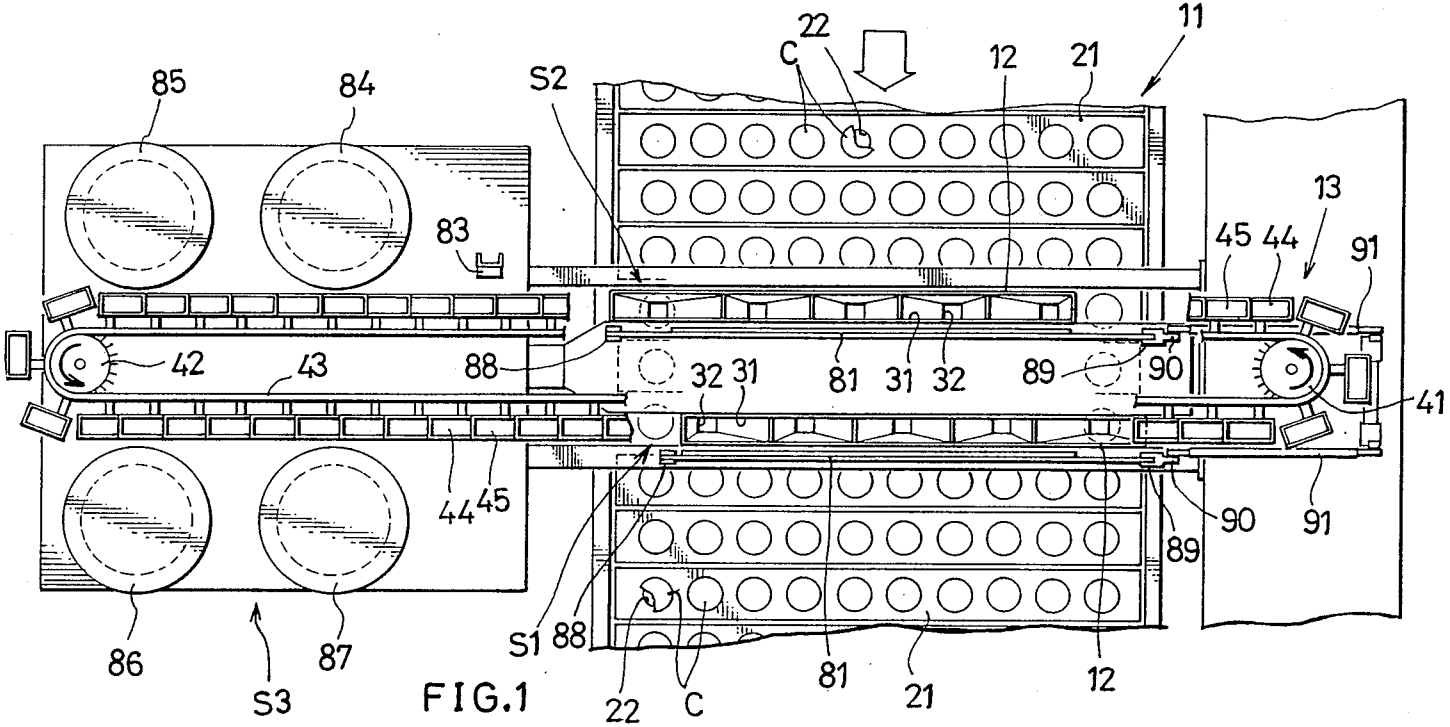
FIG. 1 is a plan view of an embodiment of the invention.
Figure 2:
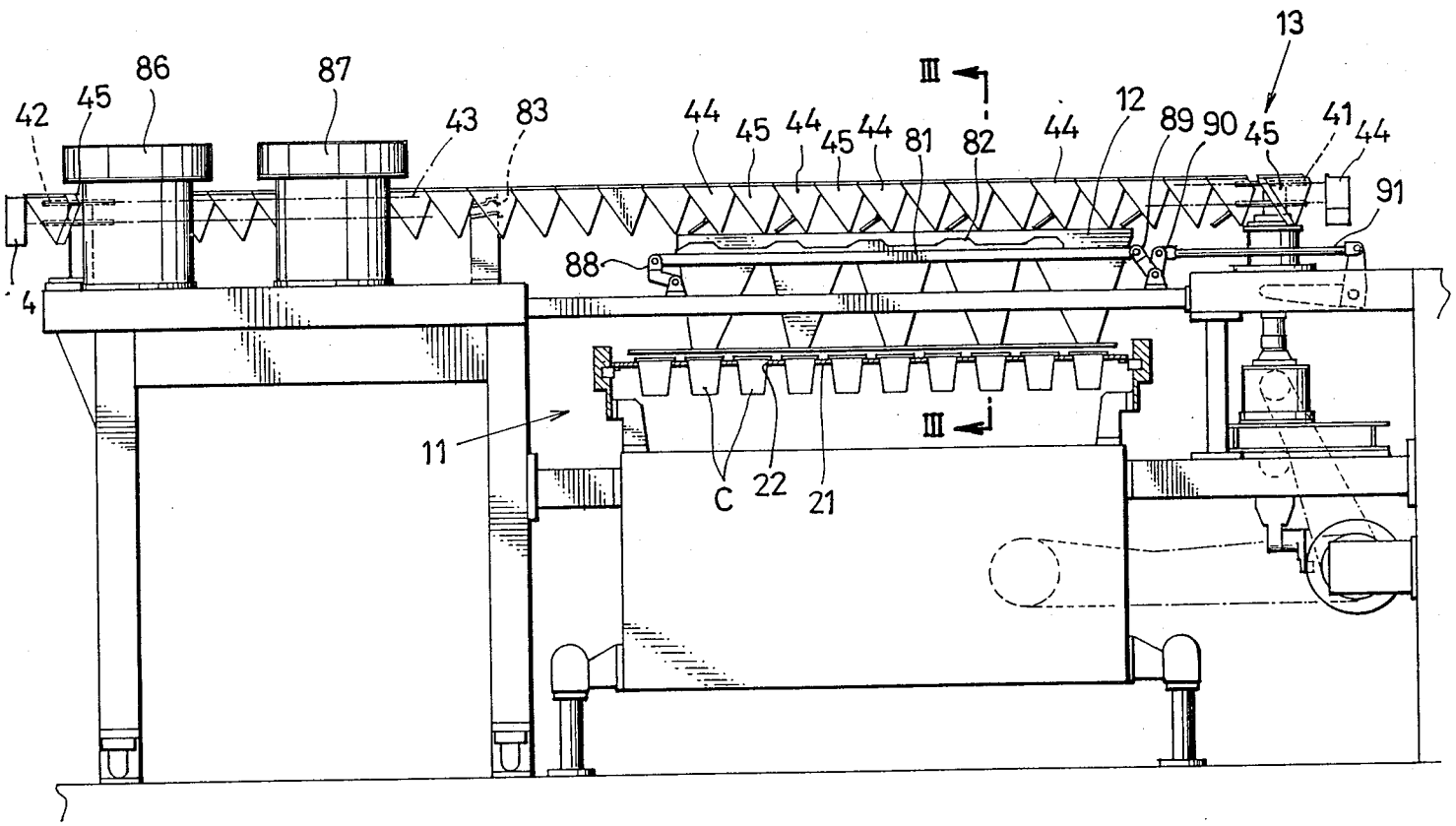
FIG. 2 is a front view of the same.

FIGS. 1 and 2 show an apparatus for distributedly filling particulate or granular materials into containers. C. The apparatus comprises the above-mentioned container conveyor 11 having ten transport paths extending forward through a first filling station Sl in the front and a second filling station S2 in the rear, ten chutes 12 arranged immediately above the transport paths, respectively, at the first filling station Sl or the second filling station S2, and a particulate or granular material conveyor 13 extending across and positioned above the chutes 12.

On the left side of the first and second filling stations Sl, S2, there is a feed station S3, where feeders 84 to 87 are disposed for supplying different kinds of particulate or granular materials.

The container conveyor 11 is a slat conveyor having slats 21 each of which is formed with ten apertures 22 arranged longitudinally thereof. The container C, which is cuplike and has a flange, is inserted in the aperture 22 and supported at the flange by the aperture-defining edge of the slat. Thus, each slat 21 holds ten containers C thereon. The conveyor 11 is so driven that the slats 21 successively stop at the first and second stations Sl and S2.

Figure 3:
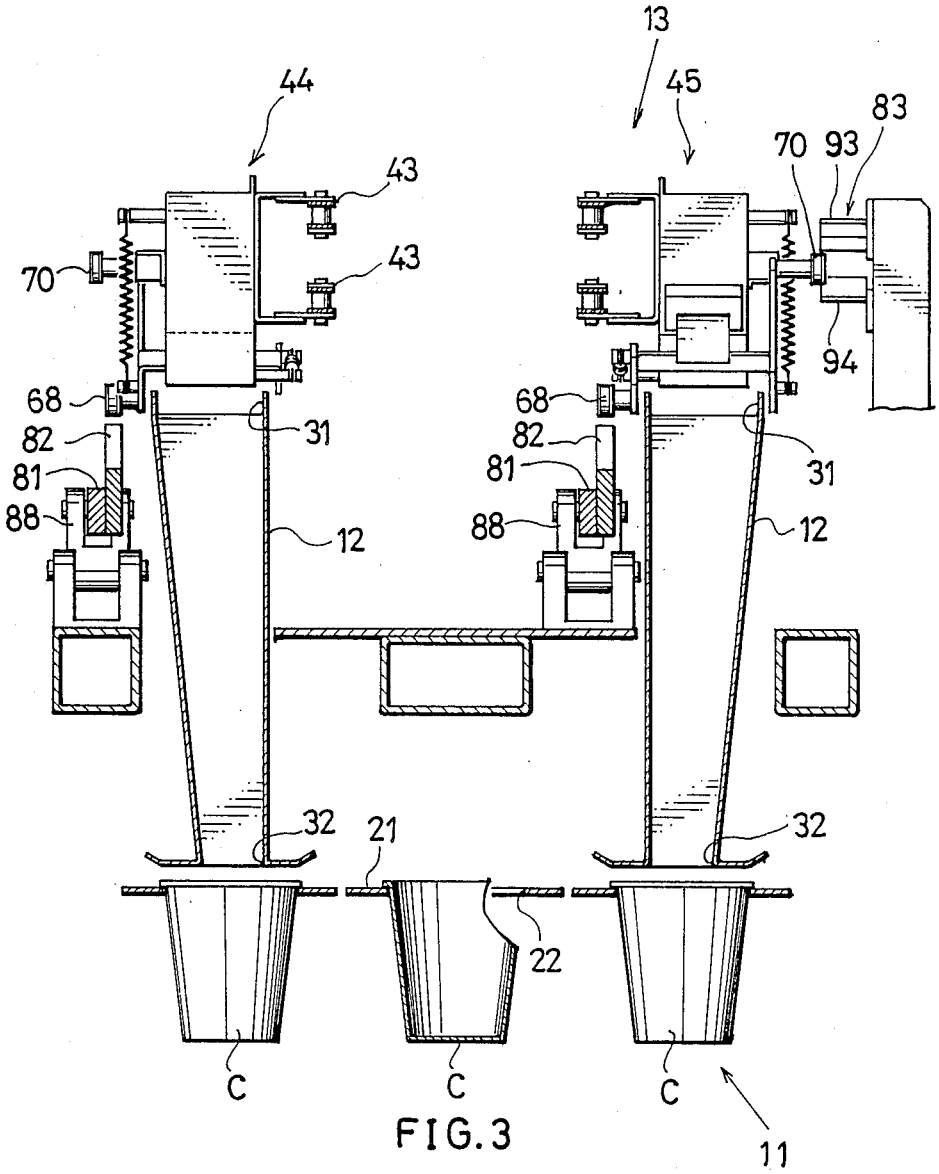
FIG. 3 is an enlarged view in section taken along the line III—III in FIG. 2.

As seen in greater detail in FIG. 3, the chute 12 is tubular and has an inlet 31 at its upper end and an outlet 32 at its lower end. The cross sectional area of the chute 12 gradually increases from the outlet 32 toward the inlet 31. Half of the ten chutes 12, i.e. five first chutes 12, are so arranged that the outlets 32 thereof are opposed to the respective containers C stopped at the first filling station Sl in the even-numbered transport paths, i.e., the second, fourth, sixth, eighth and tenth paths from the left side of the conveyor 11. The remaining five chutes 12, i.e. second chutes 12, are so arranged that the outlets 32 thereof are positionable above the respective containers C stopped at the second filling station S2 in the odd-numbered transport paths, i.e., the first, third, fifth, seventh and ninth paths from the left side.

The material transport conveyor 13 comprises a right drive sprocket 41 and a left driven sprocket 42 arranged at the opposite sides of the arrangement of chutes 12, a pair of upper and lower horizontal endless chains 43 reeved around these sprockets 41, 42, and a multiplicity of buckets 44, 45 arranged alternately and attached to the chains 43 at the same spacing as the container transport paths. The buckets 44, 45 are movable above the inlets 31 of all the first chutes 12 when traveling along the forward path of the chains and above the inlets 31 of all the second chutes 12 when traveling along the return path of the chains.

Figure 4:
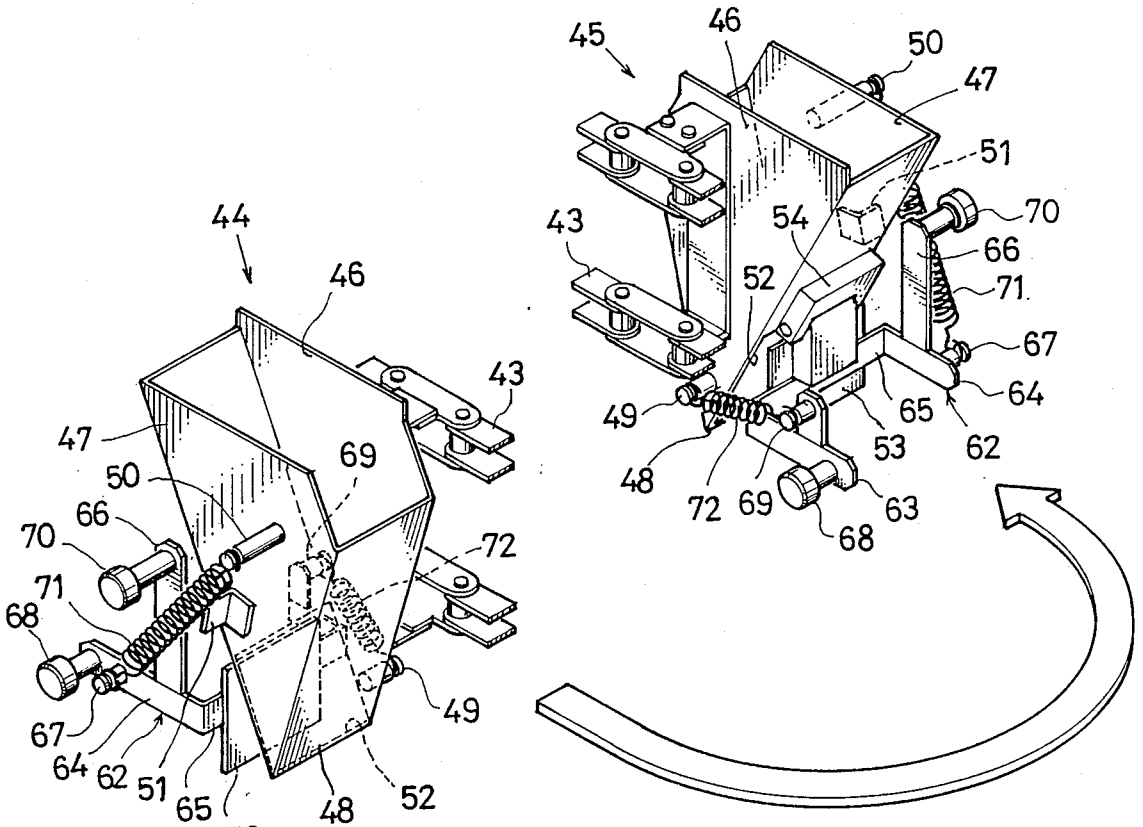
FIG. 4 is a perspective view showing two kinds of buckets.

There are two kinds of buckets 44, 45 as seen in FIG. 4. Those of one kind are first buckets 44 for the first chutes 12, and those of the other kind are second buckets 45 for the second chutes 12. Since the buckets 44, 45 are identical in construction with the exception of the difference to be stated later, the first bucket 44 will be chiefly described below.

Figure 5:
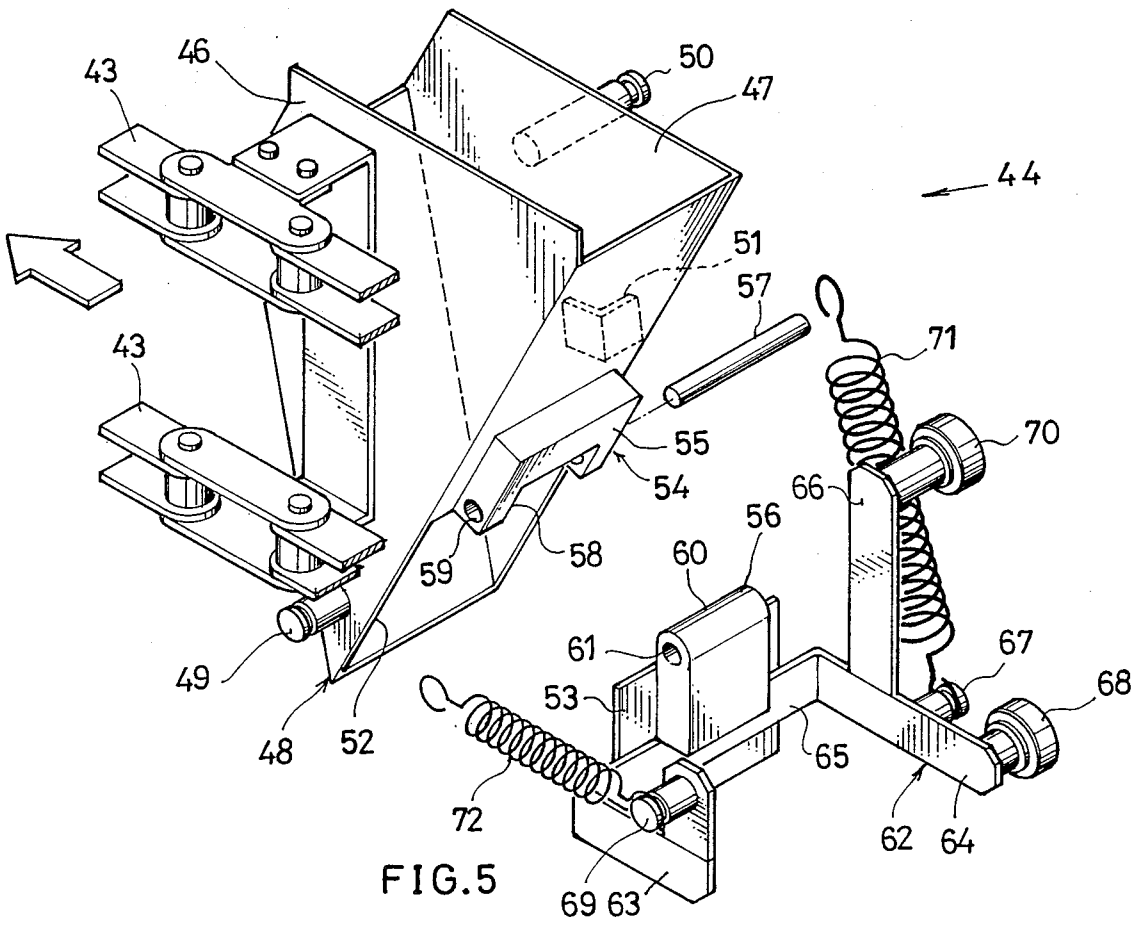
FIG. 5 is an exploded perspective view showing one of the buckets.

As shown in FIG. 5 in detail, the first bucket 44 comprises inner and outer side walls 46, 47 opposed to each other and each generally in the form of an inverted triangle, and a bottom wall 48 V-shaped in section, composed of two slanting plates and interconnecting the side walls 46, 47 at their downwardly slanting edges. The inner side wall 46 has an auxiliary spring holding pin 49 close to its lower end. The outer side wall 47 has a main spring holding pin 50 close to its upper end and a stopper 51 positioned obliquely below the pin 49 toward the direction of travel of the bucket. Of the two slanting plates, the plate toward the direction of travel is formed in its lower portion with a rectangular outlet 52 which is closable with a rectangular closure plate 53 attached to the bucket 44 with a hinge 54. The hinge 54 comprises a first hinge member 55 secured to the outer surface of the bottom wall 48 at the upper edge thereof defining the outlet 52, a second hinge member 56 secured to the upper portion of the closure 53 on the outer surface thereof, and a horizontal pin 57 interconnecting the two hinge members 55, 56. The first hinge member 55 is in the form of a flat block having a cutout 58 at its lower portion. The opposite side portions of the member 55 defining the cutout 58 have a pin bore 59. Like the first hinge member 55, the second hinge member 56 is in the form of a flat block and has an upward projection 60 projecting upward beyond the closure 53 and having a round top end. The projection 60 has a pin bore 61 corresponding to the pin bores 59 of the first hinge member 55. The upward projection 60 is fitted in the cutout 58 with the pin bore 61 of the second hinge member 56 in alignment with the two pin bores 59 of the first hinge member 55, and the horizontal pin 57 is inserted through the bores 59, 61 in this state.

The closure 53 has a closure opening arm 62 attached thereto. The opening arm 62 comprises inner and outer lateral members 63, 64 opposed to each other, a connecting member 65 interconnecting the opposed inner ends of the lateral members 63, 64 and secured at its lengthwise middle portion to the closure 53, and a vertical member 66 extending upward from a lengthwise intermediate portion of the outer lateral member 64. The inner lateral member 63 has an auxiliary spring holding pin 69 at its outer end. A main spring holding pin 67 is attached to another lengthwise intermediate portion of the outer lateral member 64, which is provided with a closure opening cam follower 68 at its outer end. The vertical member 66 carries a closure closing cam follower 70 at its upper end. A main coiled tension spring 71 extends between the pin 50 on the bucket 44 and the pin 67 on the opening arm 62 in engagement therewith, while an auxiliary coiled tension spring 72 extends between the pin 49 on the bucket 44 and the pin 69 on the opening arm 62 in engagement therewith.

Figure 6:
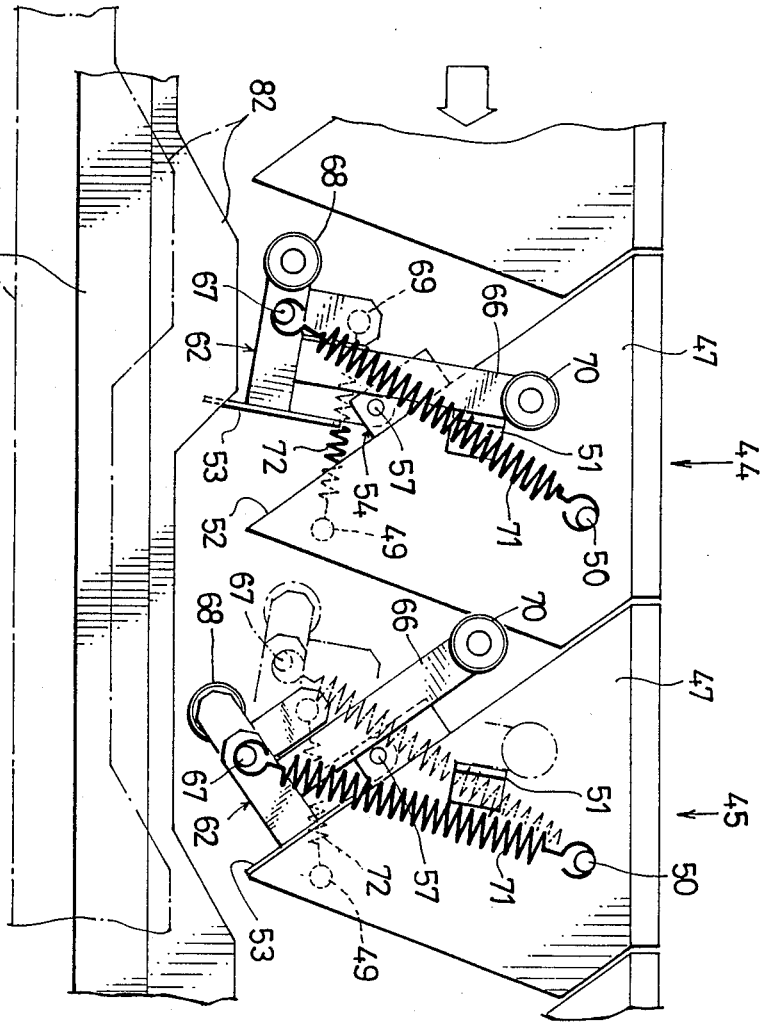
FIGS. 6 and 7 are views showing how the buckets are opened and closed.

With reference to FIG. 6, the main coiled tension spring 71 is movable across the axis of the horizontal pin 57 which is the center of pivotal movement of the closure 53, with the opening or closing of the closure 53. The closure 53 is held in its open position and also in its closed position by the spring 71. The auxiliary spring 72 assists the main spring 71 in holding the closure 53 closed.

The second bucket 45 differs from the first bucket 44 described above in that the inner and outer lateral members 63, 64 of the closure opening arm 62 of the second bucket 45 are in a reverse inner-outer relation with those of the first bucket 44.

With reference to FIGS. 1 and 2 again, a horizontal first lift rail 81 and a horizontal second lift rail 81 extend across the container conveyor 11 thereabove and are positioned in front of and along the forward chain path and the return chain path, respectively. A guide rail 83 is further disposed downstream from the second lift rail 81 along the return chain path.

Each of the first and second lift rails 81 is in the form of an elongated plate, has five upwardly projecting cams 82 equal in number to the number of the first or second chutes 12 and is supported at its opposite ends by parallel links 88, 89. The cams 82 are arranged at the same spacing as the adjacent chutes 12. Of the two links 88, 89, the right link 89 is integral with an arm 90, which is connected at its free end to a movable rod 91. The rod 91, when moved forward and backward, pivotally moves the links 88, 89 through the arm 90, whereby the lift rail 81 is moved upward and downward while being moved leftward and rightward.

Figure 7:
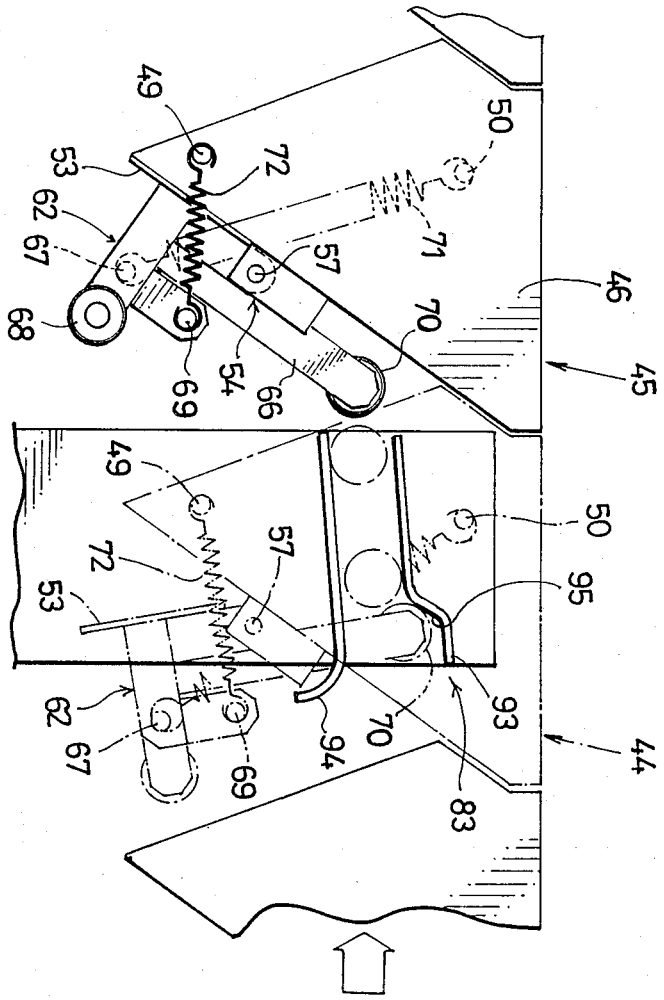

As seen in detail in FIG. 7, the guide rail 83 comprises upper and lower guide plates 93, 94 opposed to each other and extending along the return chain path slightly leftwardly downward. The upper guide plate 93 has at its right end a cam 95 extending rightwardly upward. The upper and lower guide plates 93, 94 are so arranged that the cam 95 is at the same level as the closure closing cam follower 70 when the closure 53 is open. With the movement of the bucket 44 or 45, the cam follower 70 is depressed by the cam 95 upon coming into contact therewith, whereby the closure 53 is closed.

The container conveyor 11 and the material conveyor 13 are driven in the following manner in synchronism with each other. The material conveyor 13 is driven continuously while the container conveyor 11 is intermittently driven to sequentially move each row of containers into position beneath the first and second filling stations S1 and S2. Simultaneously with each intermittent movement of the container conveyor, each of the buckets 44 and 45 move a distance equal to the spacing between the adjacent chutes 12 multiplied by the number of first or second chutes 12. Thus, when five containers C stop at each of the first and second filling stations S1, S2, beneath the first record chutes five first buckets 44 are in position to transverse the inlets 31 of the respective first chutes 12, and five second buckets 45 the respective second chutes 12, with one bucket moving each chute. Each time the container conveyor 11 is intermittently driven, the first and second lift rails 81 are also simultaneously raised and lowered once in timed coordination with the operation of the material conveyor 13. The lift rails 81 are raised immediately before the buckets 44, 45 are moved to a position above the inlets 31 of chutes 12, whereupon the closure opening cam followers 68 ride on the cams 82, opening the closures 53 of the ten buckets 44 and 45 about the chutes 12 at the same time. This causes the buckets 44, 45 to release the particulate or granular materials, which fall through the chutes 12 and are received by the containers C positioned therebelow. The closures 53 are thereafter closed as the buckets move along the return chain path by the guide plates 93, 94 of guide rail 83 as already described. The portions of material to be subsequently distributedly filled are supplied to the buckets 44, 45 by the feeders 84 to 87.

What is claimed is:

1. An apparatus for distributedly filling a particulate or granular material into containers comprising:

an apparatus frame having first and second filling stations, a container conveyor having an even number of spaced container transport paths extending through the first and second filling stations, the container conveyor being adapted to be driven intermittently so as to stop containers at the first and second filling stations during transport, first chutes equal in number to one-half of the number of container transport paths and so arranged and spaced as to have their lower-end openings disposed above the respective containers stopped at the first filling station in the even-numbered transport paths as arranged from one side of the container conveyor, second chutes equal in number to one-half of the number of container transport paths and so arranged and spaced as to have their lower-end openings disposed above the respective containers stopped at the second filling station in the odd-numbered transport paths as arranged from said one side of the container conveyor, a particulate or granular material conveyor having an endless material transport path including a forward path portion and a return path portion, the path portions extending across and being positioned above the even number of spaced container transport paths, the material conveyor having a chain extending along the material transport path and first and second buckets arranged alternately and attached to the chain at the same spacing as the container transport paths, the buckets being movable above the upper-end openings of all the first chutes when traveling through the forward path portion and above the upper-end openings of all the second chutes when traveling through the return path portion, the material conveyor being so driven continuously that each time the container conveyor is intermittently driven, each bucket moves by a distance equal to the spacing between adjacent chutes multiplied by the number of first or second chutes, a number of said first buckets being positionable above the upper-end openings of the respective first chutes and a number of said second buckets being positionable above the upperend openings of the respective second chutes when containers being transported are stopped at the first and second filling stations, and means operable only one each time the container conveyor is intermittently driven to place the particulate or granular material into the first and second chutes respectively from the first and second buckets positioned above the upper-end openings of the first and second chutes while the containers are stopped at the first and second filling stations.

2. An apparatus for distributedly filling a particulate or granular material into containers comprising:

an apparatus frame having first and second filling stations, a container conveyor having an even number of spaced container transport paths extending through the first and second filling stations, the container conveyor being adapted to be driven intermittently so as to stop containers at the first and second filling stations during transport, first chutes equal in number to one-half of the number of container transport paths and so arranged and spaced as to have their lower-end openings disposed above the respective containers stopped at the first filling station in the even-numbered transport paths as arranged from one side of the container conveyor, second chutes equal in number to one-half of the number of container transport paths and so arranged and spaced as to have their lower-end openings disposed above the respective containers stopped at the second filling station in the odd-numbered transport paths as arranged from said one side of the container conveyor, a particulate or granular material conveyor having an endless material transport path including forward path portion and a return path portion, the path portions extending across and being positioned above the even number of spaced container transport paths, the material conveyor having a chain extending along the material transport path and first and second buckets arranged alternately and attached to the chain at the same spacing as the container transport paths, the buckets being movable above the upper-end openings of all the first chutes when traveling through the forward path portion and above the upper-end openings of all the second chutes when traveling through the return path portion, the material conveyor being so driven continuously that each time the container conveyor is intermittently driven, each bucket moves by a distance equal to the spacing between the adjacent chutes multiplied by the number of first or second chutes, a number of said first buckets being positionable above the upper-end openings of the respective first chutes and a number of said second buckets being positionable above the upper-end openings of the respective second chutes when containers being transported are stopped at the first and second filling stations, each of the buckets having an outlet at its bottom and a closure pivoted to each bucket by a horizontal pin perpendicular to the direction of travel of the bucket and movable between opened and closed positions with respect to the outlet, a coiled tension spring being attached at its one end to the bucket and at the other end thereof to the closure and being movable across the axis of the horizontal pin with the opening and closing movement of the closure to hold the closure in its closed position and also in its opened position, the closure having an opening cam follower and a closing cam follower both projecting in a direction perpendicular to the direction of movement of said buckets, a first horizontal lift rail extending along the forward path portion and along the first chute, and a second horizontal lift rail extending along the return path portion and along the second chutes, each of the first and second lift rails having upwardly projecting cams equal in number to the number of the first or second chutes and arranged at the same spacing as the chutes, the first and second lift rails being movable in an upward stroke and a downward stroke only once each time the container conveyor is intermittently driven, the closure being openable when the closure opening cam follower rides on the cam of the first or second lift rail in the upper limit position of its upward stroke, and a guide rail disposed along the return path portion downstream from the second lift rail with respect to the direction of movement of said buckets, the guide rail having a slanting cam slanting downward in the direction of movement of said buckets, the closure in its opened position being closable by the contact of the closing cam follower with the slanting cam.

3. An apparatus for distributedly filling a particulate or granular material into containers comprising:

an apparatus frame having first and second filling stations, and a feed station provided in parallel with the filling stations, a container conveyor having an even number of spaced container transport paths extending through the first and second filling stations, the container conveyor being adapted to be driven intermittently so as to stop containers at the first and second filling stations during transport, first chutes equal in number to one-half of the number of container transport paths and so arranged and spaced as to have their lower-end openings disposed above the respective containers stopped at the first filling station in the even-numbered transport paths as arranged from one side of the container conveyor, second chutes equal in number to one-half of the number of container transport paths and so arranged and spaced as to have their lower-end openings disposed above the respective containers stopped at the second filling station in the odd-numbered transport paths as arranged from said one side of the container conveyor, a particulate or granular material conveyor having an endless material transport path extending from the feed station to the two filling stations and having a forward path portion and a return path portion, the path portions extending across and above the spaced container transport paths at the two filling stations, the material conveyor having a chain extending along the material transport path and first and second buckets arranged alternately and attached to the chain at the same spacing as the container transport paths, each of the buckets having a bottom closure, the buckets being movable above the upper-end openings of all the first chutes when traveling through the forward path portion and above the upper-end openings of all the second chutes when traveling through the return path portion, the material conveyor being so driven continuously that each time the container conveyor is intermittently driven each bucket moves by a distance equal to the spacing between adjacent chutes multiplied by the number of first or second chutes, a number of said first buckets being positionable above the upper-end openings of the respective first chutes and a number of said second buckets being positionable above the upper-end openings of the respective second chutes when containers being transported are stopped at the first and second filling stations, a feeder provided at the feed station for supplying the particulate granular material to the first and second buckets, closure opening means operable only once each time the container conveyor is intermittently driven to open the bottom closures of said number of first buckets and said number of second buckets while the containers are stopped at the first and second filling stations and closure closing means to thereafter close the bottom closures before the material is supplied to the first and second buckets by the feeder.

4. An apparatus for distributedly filling a particulate or granular material into containers comprising:

an apparatus frame having first and second filling stations, and a feed station provided in parallel with the filling stations, a container conveyor having an even number of spaced container transport paths extending through the first and second filling stations, the container conveyor being adapted to be driven intermittently so as to stop containers at the first and second filling stations during transport, first chutes equal in number to one-half of the number of container transport paths and so arranged and spaced as to have their lower-end openings disposed above the respective containers stopped at the first filling station in the even-numbered transport paths as arranged from one side of the container conveyor, second chutes equal in number to one-half of the number of container transport paths and so arranged and spaced as to have their lower-end openings disposed above the respective containers stopped at second filling station in the odd-numbered transport paths as arranged from said one side of the container conveyor, a particulate or granular material conveyor having an endless material transport path extending from the feed station to the two filling stations and having a forward path portion and a return path portion, the path portions extending across the spaced container transport paths and being positioned thereabove at the two filling stations, the material conveyor having a chain extending along the material transport path and first and second buckets arranged alternately and attached to the chain at the same spacing as the container transport paths, the buckets being movable above the upper-end openings of all the first chutes when traveling through the forward path portion and above the upper-end openings of all the second chutes when traveling through the return path portion, the material conveyor being so driven continuously that each time the container conveyor is intermittently driven, each bucket moves by a distance equal to the spacing between adjacent chutes multiplied by the number of first or second chutes, a number of said first buckets being positionable above the upper-end openings of the respective first chutes and a number of said second buckets being positionable above the upper-end openings of the respective second chutes when containers being transported are stopped at the first and second filling stations, a feeder provided at said feed station for supplying the particulate or granular material to the first and second buckets, each of the buckets having an outlet at its bottom and a closure pivoted to each bucket by a horizontal pin perpendicular to the direction of travel of the bucket and movable between opened and closed positions relative to the outlet, a coiled tension spring being attached at its one end to the bucket and at the other end thereof to the closure and being movable across the axis of the horizontal pin with the opening and closing movement of the closure to hold the closure in its closed position and also in its opened position, the closure having an opening cam follower and a closing cam follower both projecting in a direction perpendicular to the direction of movement of said buckets, a first horizontal lift rail extending along the forward path portion and along the first chutes, and a second horizontal lift rail extending along the return path portion and along the second chutes, each of the first and second lift rails having upwardly projecting cams equal in number to the number of the first or second chutes and arranged at the same spacing as the chutes, the first and second lift rails being movable in an upward stroke and a downward stroke only once each time the container conveyor is intermittently driven, the closure being openable when the closure opening cam follower rides on the cam of the first or second lift rail in the upper limit position of its upward stroke, and a guide rail disposed along the return path portion downstream from the second lift rail but upstream from the feed station with respect to the direction of movement of said buckets, the guide rail having a slanting cam slanting downward in the direction of movement of said buckets, the closure in its opened position being closable by the contact of the closing cam follower with the slanting cam.

* * * * *